United States Patent [19]

Prawdzik

[11] Patent Number: 4,521,019

[45] Date of Patent: Jun. 4, 1985

[54] KICKER WHEEL WITH REPLACEABLE SURFACE FOR BOWLING APPARATUS

[75] Inventor: Joseph F. Prawdzik, Irving, Tex.

[73] Assignee: Tiger Products, Inc., Irving, Tex.

[21] Appl. No.: 400,791

[22] Filed: Jul. 22, 1982

[51] Int. Cl.[3] ..... A63D 5/02

[52] U.S. Cl. ..... 273/49; 273/DIG. 8

[58] Field of Search ..... 273/49; 46/221, 222, 46/223; 51/206 R; 198/642

[56] References Cited

U.S. PATENT DOCUMENTS

| | | | |
|---|---|---|---|
| 1,162,970 | 12/1915 | Binford | 51/206 R X |
| 2,600,918 | 6/1952 | Pohl | 273/49 |
| 2,964,318 | 12/1960 | Levendoski | 273/49 |
| 3,101,195 | 8/1963 | Szost | 273/49 |
| 3,297,322 | 1/1967 | Ernst et al. | 273/49 X |
| 3,638,352 | 2/1972 | Christiansen | 46/221 X |
| 3,899,171 | 8/1975 | Haller | 273/DIG. 8 |
| 4,270,305 | 6/1981 | Samuels | 46/221 |

*Primary Examiner*—Anton O. Oechsle

*Attorney, Agent, or Firm*—Drude Faulconer

[57] ABSTRACT

A kicker wheel roller assembly for an automatic bowling ball return mechanism comprising a permanent hub member and a replaceable contact surface member frictionally mounted thereof. The contact surface member is formed of an elastomeric resilient friction material, e.g. polyurethane, and has a non-circular opening, e.g. square, splined, etc., therethrough which is received on a matching non-circular driving portion of the hub member. The conformed non-circular mating surfaces provide a positive driving connection between the hub and contact surface members. The contact surface member is held on the hub only by its resiliency and can be easily positioned onto and removed from the hub which, in turn, is reuseable.

9 Claims, 6 Drawing Figures

4 4

KICKER WHEEL WITH REPLACEABLE SURFACE FOR BOWLING APPARATUS

BACKGROUND OF THE INVENTION

The present invention relates to bowling equipment and more particularly relates to a "kicker wheel" roller assembly for an automatic bowling ball return mechanism wherein the contact surface of the roller assembly is replaceable.

Many of the ball returns mechanisms used in commercial bowling houses include a rotating, kicker wheel roller assembly which engages a bowling ball as it leaves the pit and directs it onto the ball track of the return. These kicker wheel roller assemblies are of unitary construction and are formed of a contact surface of a rubber or other suitable elastomeric resilient friction material which is bonded or otherwise permanently affixed to a hub portion. As known, the contact surface of the kicker wheel wears relatively quickly and the entire wheel assembly has to be replaced at frequent intervals. Although the cost of an individual kicker wheel assembly is small when compared to the initial cost of the return mechanism, itself, the total cost of the large number of replacement wheel assemblies which are normally required over any substained period quickly becomes a substantial consideration in a highly competitive business where even small savings in maintenance and operating costs may be the difference between profit or loss for a particular bowling operation.

SUMMARY OF THE INVENTION

The present invention provides a kicker wheel roller assembly for a bowling ball return mechanism wherein the contact surface thereof can be easily and quickly replaced without the need for replacing the entire assembly.

More specifically, the kicker roller assembly of the present invention is comprised of a permanent hub member onto which a replaceable contact surface member is removably positioned. The hub member is comprised of a durable material, e.g. aluminum, steel, hard rubber, or the like, having a bore therethrough adapted to be positioned on a kicker wheel roller shaft of a bowling ball return mechanism. A set screw or the like is provided to secure the hub member to the shaft when the hub is in a proper position thereon. The hub has a driving portion thereon which has a non-circular outer configuration, e.g. square, triangular, splined, etc., for a purpose describe below. A shoulder is also provided on the outer perihpery of the hub at the upper end of the driving portion.

The replaceable contact surface member comprises a cylindrical element formed of a suitable elastomeric, resilient friction material (e.g. polyurethane) having a thickness substantially equal to the length of the driving portion of the hub. The outer periphery of the cylindrical element provides the surface of the kicker wheel roller assembly that makes contact with a bowling ball when the roller is in operation. An opening extends through the center of the cylindrical element which has an inner non-circular configuration that matches or conforms with the outer non-circular configuration of the driving portion of the hub. The dimensions of the opening are such that the cylindrical element can easily be forced onto the mating driving portion of the hub and is frictionally held thereon by the resiliency of the cylindrical element. When fully onto the hub, the cylindrical member engages the shoulder on the hub thereby insuring proper longitudinal positioning of the cylindrical element on the hub.

Due to the matching and conforming non-circular configurations on the hub member and the cylindrical, contact surface member, a positive driving connection is formed between the two members so that the contact surface member rotates as a unit with the hub member. However, since no bonding, adhesive, or the like is used to secure the members together, once the contact surface member wears down, it can be removed by merely pulling it off the hub and quickly replaced with a new contact surface member. By retaining and reusing the permanent hub member and only replacing the less expensive contact surface member, the cost of maintaining kicker wheel rollers in the ball return mechanism of this type is substantially reduced, e.g. as much as 30 to 40% of the previous cost for this maintenance operation.

BRIEF DESCRIPTION OF THE DRAWINGS

The actual construction, operation, and apparent advantages of the invention will be better understood by referring to the drawings in which like numerals identify like parts and in which.

DESCRIPTION OF THE PREFERRED EMBODIMENT

Figure 1:
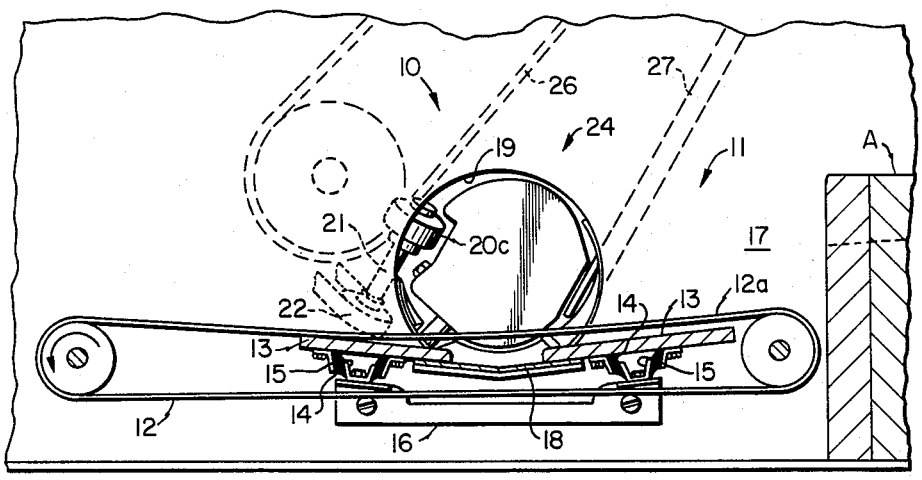
FIG. 1 is a side view of a pit of a bowling lane illustrating the position of a kicker wheel roller in an automatic ball return mechanism.

Referring more particularly to the drawings, FIG. 1 is illustrative of an automatic ball return 10 in which the present invention is intended to be used. As will be understood by those skilled in the art, bowling pins (not shown) and bowling balls (not shown) drop into pit 11 from alley A and are carried rearward by conveyor 12. Located beneath the upper lap **12*a* of conveyor 12 are bounce boards 13 which extend transversely across pit 11 and are supported on the resilient blocks 14 secured to channels 15 which, in turn are attached to brackets 16 (only one shown) mounted on the sides or "kickback" 17 of pit 11. A plate 18 is provided between bounce boards 13 to provide a groove into which a ball may depress upper lap 12*a* as the ball moves thereover to allow the ball to roll off lap 12*a* and through ball door 20 in kickback 17**.

As a ball exits pit 11 through door 19, it comes into contact with kicker wheel roller **20*c* which is affixed to shaft 21 which, in turn, is continuously rotated by belt 22. Rotating kicker wheel roller 20*c* frictionally engages the ball and directs or "kicks" the ball into ball elevating mechanism 24 which, in turn, is comprised of conveyor belt 26 and ball track 27. The spacing between conveyor belt 26 and track 27 decreases upwardly so that the ball will be frictionally carried upward on track 27** to a return chute (not shown) by conveyor belt 26 when a ball is trapped therebetween. Ball return mechanisms of the type described are well known in the art and are in widespread use in commercial bowling houses. Examples of such a return mechanism are Automatic Pin Setters, Models 8230 and 8270, distributed by American Machine & Foundry Company (AMF) and which are basically disclosed and described in U.S. Pat. No. 3,297,322 which is incorporated herein by reference.

The kicker wheel roller 20 of the present invention is adpated to replace roller 20*c* of the ball return mechanism 10 shown in FIG. 1 and described above. Roller 20 is comprised of a permanent hub member 25 and a replaceable contact surface member 26. Hub member 25 is formed from a durable material, e.g. aluminum, steel, hard rubber, or the like and has bore 27 therethrough of a proper diameter to fit over shaft 21 of ball return mechanism 10.

Figure 2:
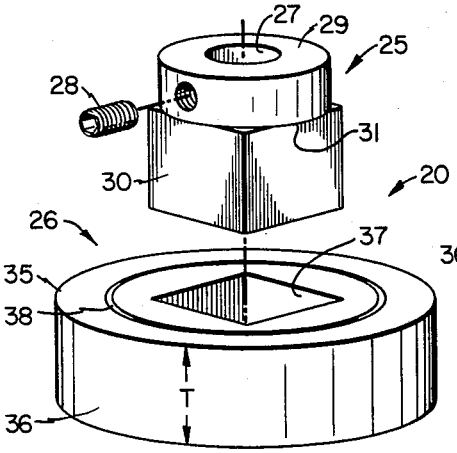
FIG. 2 is an exploded view of a kicker wheel roller in accordance with the present invention.
Figure 5:
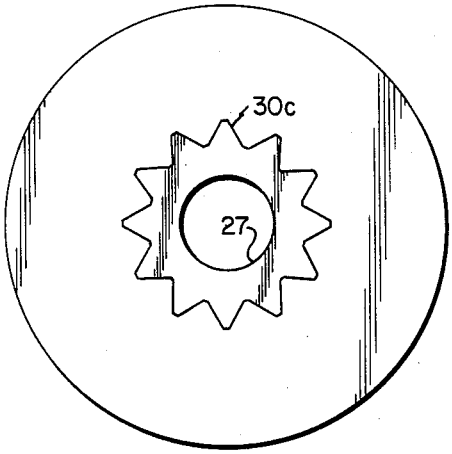
FIG. 5 is a bottom view of still another embodiment of the present invention.

As illustrated, hub member 25 has an upper portion 29 and an integrally formed lower, driving portion 30. Driving section 30 has a non-circular, outer periphery, e.g. square as shown in FIG. 2; splined as shown in FIG. 5; triangular (not shown), rectangular (not shown); or the like, for a purpose discussed below.

A shoulder 31 is provided on hub member 25 to insure the proper longitudinal positioning of contact surface member 26 on hub member 25. As shown, upper portion 29 is rounded and has a diameter greater than the length of a side of the square driving portion 30 that portion 29 projects at least partially outward above the periphery of the driving portion 30 to form shoulder 31. However, it should be understood that shoulder 31 can be formed in other ways without departing from the present invention. For example, although not shown, upper 29 and lower 30 portions of hub member 25 can be integral and of the same dimensions throughout their combined length (e.g. square from top to bottom). A groove is provided around the periphery of hub 25 to thereby define upper and lower portions 29, 30 so. A snap ring or the like is inserted in this groove and extends outward from hub 25 to provide a shoulder thereon.

Replaceable contact surface member 26 comprises a cylindrical element 35 which is molded or otherwise formed form any suitable elastomeric resilient frictional material, e.g. polyurethane, natural or synthetic rubber, or the like. The thickness T (FIG. 2) of element 35 is approximately the same as the length of driving portion 30 of hub member 25. The outer surface 36 of cylindrical element 26 provides the surface which engages the bowling balls when roller 30 is in an operating position in the ball return mechanism 10. Where a large number of light bowling balls (e.g. 9–10 pounds) are routinely encountered, an annular groove 34 (e.g. $\frac{3}{8}$ inch deep, see FIG. 3B) can be provided in and around outer peripheral surface 36 thereby providing a better gripping surface or "thread" for these light weight balls.

Cylindrical element 35 has a non-circular opening 37 (e.g. square in FIG. 2, splined in FIG. 5, etc.) through the center. Opening 37 has an inner periphery configuration and dimensions substantially identical to those of the outer periphery of driving portion 30 of hub member 25 so that member 26 can easily be forced onto driving portion 30 and held there only by the resiliency of element 35. Preferably, wear indicating groove 38 is provided in the upper surface of element 35 to warn a user when control surface member 26 wears to point where it should be replaced.

Figures 3A, 3B:
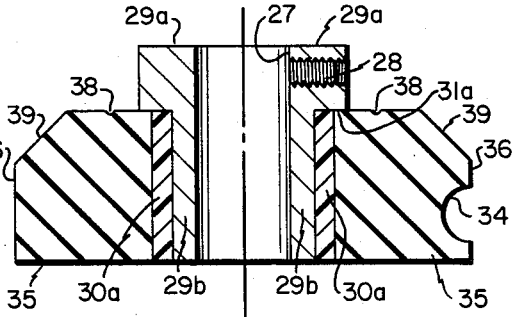
FIG. 3A is a sectional view of another embodiment of the present invention.
FIG. 3B is a sectional view of a further embodiment of the present invention.

In operation, kicker wheel roller 20 (i.e. assembled hub member 25 and replaceable contact surface member 26) is positioned on shaft 21 of ball return mechanism 10 and is held thereon by set screw 28 or the like. It should be understood that normally, kicker wheel roller 20 of the present invention will replace the single unit kicker wheel 20*c* that is commonly in use today. To aid in installation in some ball return mechanisms, the upper surface 39 of element 35 may be formed with a tapered surface 39 as shown in FIGS. 3A and 3B. When contact surface member 26 wears out, a new member 26 is now installed on permanent hub 25 which, in turn, is continuously reused. The savings which result from only having to replace contact surface member 26 are substantial.

Figure 4:
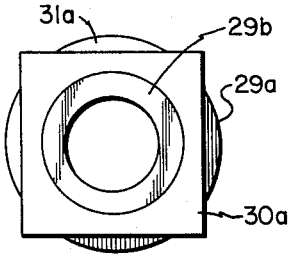
FIG. 4 is a view of the hub portion of the present invention taken along line 4—4 of FIGS. 3A and 3B.

A modified hub member 25*a* is shown in FIGS. 3A, 3B, and 4 which is useful where contact surface member 26 may wear down to the driving portion of the hub before it is detected by a user. Hub 25*a* has an upper portion 29*a* and an integral shaft 29*b* depending thereform. A driving portion 30*a* having a non-circular outer configuration is bonded or otherwise permanently affixed to shaft 29*b*. Driving portion 30*a* is formed of a material, e.g. polyurethane, which has a hardness less than that of the materials used in forming bowling balls. If contact surface member 26 wears completely out before it is detected, bowling balls will contact the softer driving portion 30*a* and will not be damaged or marred thereby.

To be more specific, the dimensions of a typical kicker wheel roller assembly are as follows. Cylindrical element 35 which may be formed of molded polyurethane has a diameter of 3 inches and a thickness T of 1 inch. Opening 37 is a $1\frac{1}{2}$ inch square. Hub 25 which may be formed of aluminum is $1\frac{1}{2}$ inch long with driving portion 30 being 1 inch long and having a $1\frac{1}{2}$ inch square periphery. Bore 27 has a $\frac{3}{8}$ inch diameter. While these dimensions are given to illustrate a typical roller assembly, it should be understood that any or all of these dimensions may be changed to meet the requirements of a particular ball return mechanism without departing from the present invention.

What is claimed is:

1. A kicker wheel roller assembly for a bowling ball return mechanism, said roller assembly comprising:

a hub member comprising:

a driving portion having a bore therethrough adapted to be positioned on a shaft of said bowling ball return mechanism, said driving portion having an upper portion and a lower portion having an outer, non-circular periphery thereon; and a replaceable contact surface member removably positioned on said driving portion of said hub member, said replaceable contact surface member comprising:

a cylindrical element formed from an elastomeric, resilient friction material, said element having an opening through the center thereof, said opening having an inner non-circular periphery which conforms to and which is received on the outer, non-circular periphery of said driving portion of said hub member.

2. The kicker wheel roller assembly of claim 1 including:

a shoulder on said hub member extending outward at the upper portion of said driving portion to properly position said replaceable contact surface member longitudinally on said hub member.

3. The kicker wheel roller assembly of claim 2 wherein said outer non-circular periphery of said driving portion and the conforming said inner non-circular periphery of said opening through said cylindrical element are rectangular.

4. The kicker wheel roller assembly of claim 3 wherein said outer non-circular periphery of said driving portion and the conforming said inner non-circular periphery of said opening through said cylindrical element are square.

5. The kicker wheel roller of claim 2 wherein said outer non-circular periphery of said driving portion and the conforming said inner non-circular periphery of said opening through said cylindrical element are splined.

6. The kicker wheel roller assembly of claim 2 wherein said elastomeric, resilient friction material is polyurethane.

7. The kicker wheel roller of claim 2 wherein a wear indicating circular groove is provided in a surface of said cylindrical element which extends perpendicular to the axis of said opening.

8. The kicker wheel assembly of claim 2 including:

an annular groove provided in and around the outer periphery of said cylindrical element.

9. A hub member for a kicker wheel assembly for a bowling ball return mechanism, said hub member comprising:

an upper portion having a shaft depending thereform, a center bore through the longitudinal axis of said upper portion and said depending shaft adapted to receive a shaft of said ball return mechanism;

a driving portion affixed on said depending shaft and having a non-circular outer periphery thereon, said driving portion being formed of polyurethane.

* * * * *